US005222469A

United States Patent [19]

Sutton

[11] Patent Number: 5,222,469

[45] Date of Patent: Jun. 29, 1993

[54] APPARATUS FOR MONITORING AN INTERNAL COMBUSTION ENGINE OF A VEHICLE

[75] Inventor: Loran W. Sutton, East Peoria, Ill.

[73] Assignee: Thermo King Corporation, Minneapolis, Minn.

[21] Appl. No.: 895,973

[22] Filed: Jun. 9, 1992

[51] Int. Cl.[5] ..... F02B 77/00

[52] U.S. Cl. ..... 123/198 DC; 123/179.4

[58] Field of Search ..... 123/198 DC, 179.4

[56] References Cited

U.S. PATENT DOCUMENTS

| | | | |
|---|---|---|---|
| 4,192,279 | 3/1980 | Maisch et al. | 123/198 DC |
| 4,286,683 | 9/1981 | Zeigner et al. | 123/198 DC |
| 4,371,051 | 2/1983 | Achtersholt | 123/198 DC |
| 4,419,866 | 12/1983 | Howland | 123/198 D |
| 4,421,075 | 12/1983 | Mandel | 123/142.5 R |
| 4,485,772 | 12/1984 | Uchida et al. | 123/179.4 |
| 4,497,291 | 2/1985 | Hamano et al. | 123/198 DC |
| 4,878,465 | 11/1989 | Hanson et al. | 123/179.6 |
| 5,072,703 | 12/1991 | Sutton | 123/179.4 |

*Primary Examiner*—Noah P. Kamen
*Attorney, Agent, or Firm*—D. R. Lackey

[57] ABSTRACT

Apparatus for monitoring an engine of a vehicle having an ignition switch operable between on and off positions, a vehicle power supply, and an electrical load, including the engine, selectively connectable to the vehicle power supply via the ignition switch. A controllable switching device is disposed between the vehicle power supply and the ignition switch. A timer accumulates time when the ignition switch is in the on position and the vehicle is stationary. If the timer reaches a predetermined time value the controllable switching device is actuated to disconnect the vehicle power supply from the ignition switch, to turn off the engine, if running, as well as disconnecting the electrical load energized via the ignition switch, limiting engine idle time, reducing engine wear and emissions, and terminating any drain on the vehicle power supply in the event the engine is not running.

21 Claims, 2 Drawing Sheets

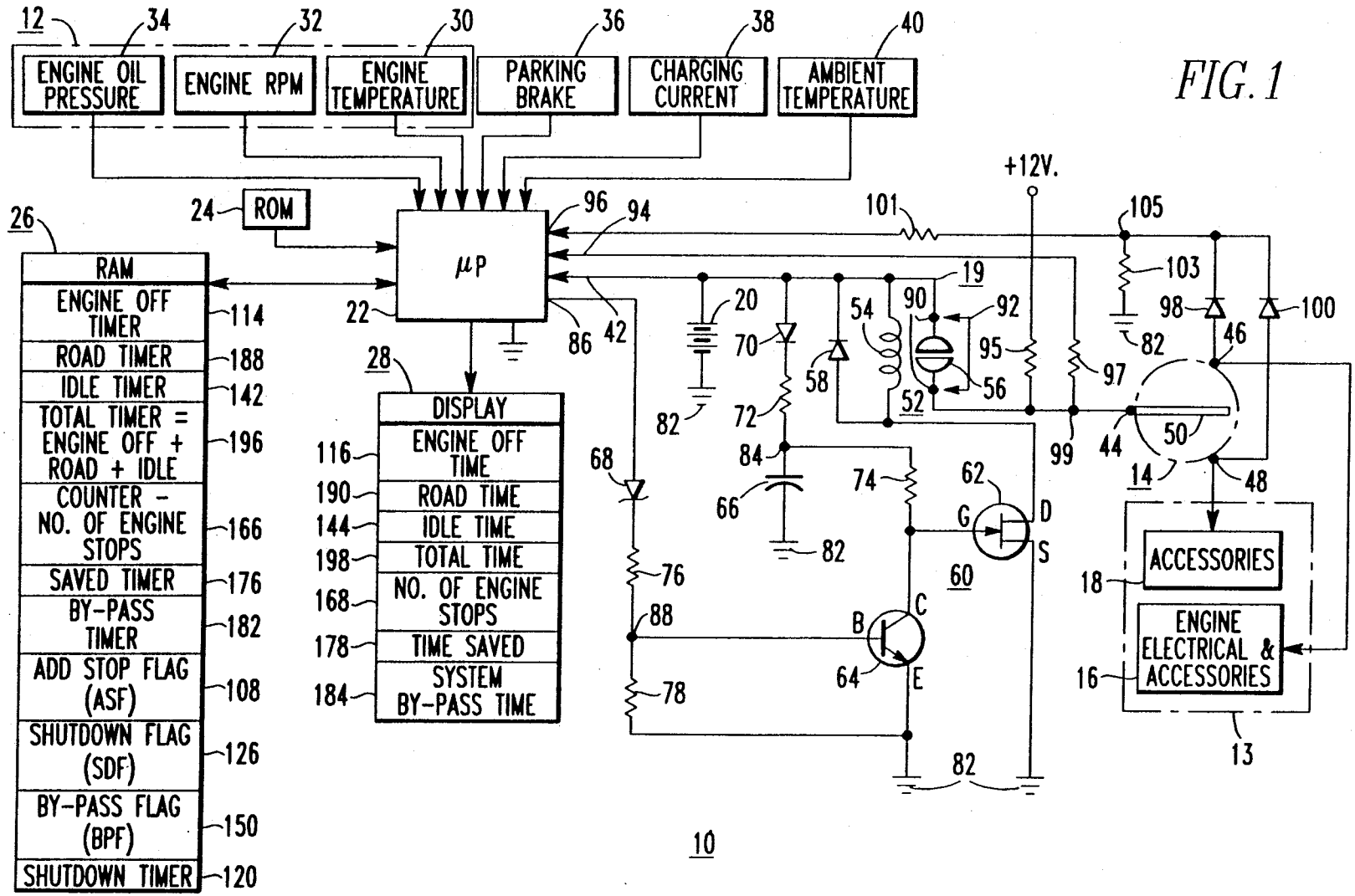
FIG. 1
ENGINE OIL PRESSURE
ENGINE RPM
ENGINE TEMPERATURE
PARKING BRAKE
CHARGING CURRENT
AMBIENT TEMPERATURE
ROM
μP
DISPLAY
ENGINE OFF TIME
ROAD TIME
IDLE TIME
TOTAL TIME
NO. OF ENGINE STOPS
TIME SAVED
SYSTEM BY-PASS TIME
RAM
ENGINE OFF TIMER
ROAD TIMER
IDLE TIMER
TOTAL TIMER = ENGINE OFF + ROAD + IDLE
COUNTER - NO. OF ENGINE STOPS
SAVED TIMER
BY-PASS TIMER
ADD STOP FLAG (ASF)
SHUTDOWN FLAG (SDF)
BY-PASS FLAG (BPF)
SHUTDOWN TIMER
ACCESSORIES
ENGINE ELECTRICAL & ACCESSORIES
+12V.

APPARATUS FOR MONITORING AN INTERNAL COMBUSTION ENGINE OF A VEHICLE

TECHNICAL FIELD

The invention relates in general to apparatus for monitoring an internal combustion engine of a vehicle to prevent unnecessary idling.

BACKGROUND ART

U.S. Pat. No. 4,421,075 maintains a diesel engine at a ready to start temperature by terminating the fuel supply of a running engine when the engine block temperature rises to a first predetermined value, and by starting the engine when the engine block temperature falls below a second predetermined value. U.S. Pat. Nos. 4,419,866 and 4,878,465 teach starting and stopping an internal combustion engine connected to a compressor in a transport refrigeration system, stopping the engine by cutting off the fuel supply when a conditioned space does not require cooling or heating to hold the temperature thereof in a range close to a selected set point temperature, and starting the engine when the conditioned space requires heating or cooling. My U.S. Pat. No. 5,072,703 teaches starting, running, and stopping a truck engine as required to maintain a truck sleeper unit in a desired temperature range, cutting off the fuel supply to stop the engine, and starting the engine when the sleeper unit requires cooling or heating.

In order to save fuel, reduce engine wear, and limit unnecessary emissions from internal combustion engines, such as engines on trucks, tractors, fork lifts, off-road vehicles, and the like, it would be desirable to automatically limit idling time, shutting off an engine which has been idling for a predetermined period of time when it is in a condition that it may be restarted. However, simply terminating the fuel supply of the engine, as in the U.S. patents listed above, would not be desirable when the engine may not be restarted for a relatively long period of time, as an electrical load connected to the vehicle power supply may soon discharge the vehicle battery to the point where restarting may not be possible.

SUMMARY OF THE INVENTION

Briefly, the present invention includes apparatus for monitoring an internal combustion engine of a vehicle having an ignition switch operable between on and off positions, a vehicle power supply, and an electrical load selectively connectable to the vehicle power supply via the ignition switch. First means controllably connects and disconnects the vehicle power supply to the ignition switch. Second means detects when the ignition switch is in the on position, and third means detects when the vehicle is stationary. Fourth means is responsive to the second and third means, timing the co-existence of the ignition switch being in the on position and the vehicle being stationary. Fifth means is responsive to the fourth means, causing said first means to disconnect the vehicle power supply from the ignition switch after the fourth means reaches a predetermined period of time.

In desirable embodiments of the invention, the fifth means is additionally responsive to one or more sensors which indicate whether or not the engine is in condition for restarting. Examples of parameters which may be sensed include engine temperature, battery charging current, output voltage from the vehicle power supply, and ambient temperature.

In still other embodiments, the number of idling engine stops performed by the monitoring apparatus, and the idling time saved thereby, are maintained in memory for continuous display purposes, and/or for downloading via data logging apparatus upon command. The monitoring apparatus also includes other desirable features, such as tabulating engine off time, engine idling time, and engine road running time, with these three times being summed to provide total time. The monitoring apparatus also includes logic for detecting when the monitoring apparatus has been rendered ineffective by a jumper connected from the vehicle power supply to the ignition switch, thereby shorting the first means. The time that the engine idles unnecessarily due to such a by-pass of the first means is also stored and displayed, and/or available for downloading upon command.

BRIEF DESCRIPTION OF THE DRAWINGS

The invention will become more apparent by reading the following detailed description in conjunction with the drawings, which are shown by way of example only, wherein:

FIG. 1 is a partially block and partially schematic diagram of engine monitoring apparatus constructed according to the teachings of the invention.

DESCRIPTION OF PREFERRED EMBODIMENTS

Figure 2:
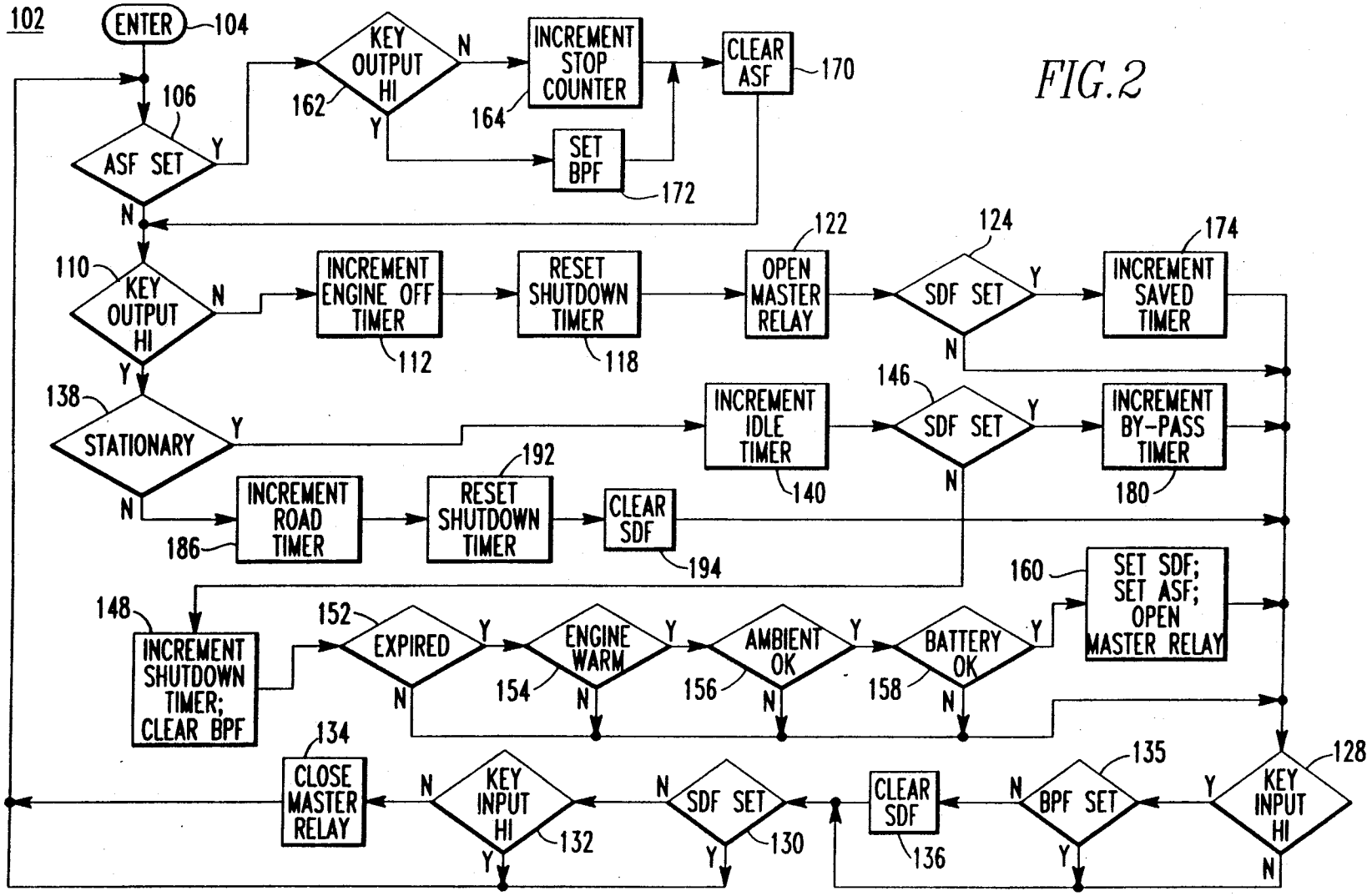
FIG. 2 is a detailed flow diagram of a program for operating a microprocessor shown in FIG. 1.

Referring now to the drawings, and to FIG. 1 in particular, there is shown a partially block and partially schematic diagram of engine monitoring apparatus 10 constructed according to the teachings of the invention. Monitoring apparatus 10 monitors an internal combustion engine of a vehicle, such as a straight truck, a tractor of a tractor-trailer combination, a fork lift, an off-road vehicle, and the like. The engine and associated vehicle are respectively indicated by broken outlines 12 and 13, with a vehicle ignition switch 14 being separately shown. Broken outline 12, representing the internal combustion engine, is illustrated enclosing a plurality of engine sensors, and broken outline 13, representing the vehicle, encloses blocks 16 and 18. Block 16 indicates an engine starter and associated electrical system, as well as electrical accessories of the vehicle 13 which are energized by an engine starting position of ignition switch 14. Block 18 indicates electrical accessories of vehicle 13 which are energized by an "accessory" position of ignition switch 14. The vehicle electrical power supply, which is indicated generally by conductor 19, includes a battery 20, an alternator or generator (not shown), and a voltage regulator (not shown).

Monitoring apparatus 10, in a preferred embodiment of the invention, includes a microprocessor 22. Microprocessor 22 includes a read-only-memory (ROM) 24, with ROM 24 storing an application specific program illustrated by the flow diagram of FIG. 2. Microprocessor 22 also includes a random-access-memory (RAM) 26 for storing program variables, timers, flags, and the like. Certain of the parameters stored in RAM 26 may be displayed on a continuously updated display 28, and/or the stored parameters may be maintained in RAM 26 until downloaded by authorized personnel via a suitable data logging device.

Microprocessor 10 receives inputs from a plurality of sensors associated with internal combustion engine 12, certain of which are optional, as will be hereinafter explained. Illustrated are an engine temperature sensor 30, which indicates the temperature of the engine 12, such as engine coolant temperature sensor or an engine block temperature sensor, an engine speed (RPM) sensor 32, and an engine oil pressure sensor 34.

Other inputs to microprocessor 22 include an input from a vehicle parking brake sensor 36, which indicates whether the parking brake is engaged or disengaged, an input from a current sensor 38 responsive to the magnitude of the charging current of battery 20, an input from an ambient temperature sensor 40, and a vehicle power supply input 42 from the vehicle power supply 19, which includes battery 20.

Ignition switch 14 includes an input or battery post 44, a first output or ignition post 46, a second output or accessory post 48, and a movable switch element 50 which is connected to battery post 44 and selectively engageable with either of the output posts 46 or 48.

Instead of having battery post 44 permanently connected to the vehicle power supply 19, as in the prior art, the present invention connects the vehicle power supply 19 to the battery post 44 via switching means 52 which controllably connects and disconnects the vehicle power supply 19 to the battery post 44 of ignition switch 14. Switching means 52 may be a solid state switching device; or, as illustrated, switching means 52 may include an electromechanical relay having an electromagnetic coil 54 and contacts 56, with a diode 58 being connected across coil 54. Contacts 56 are illustrated as being normally open, which is preferred, but the associated control may be changed to use normally closed contacts. Switching means 52 will be hereinafter referred to as master relay 52.

Microprocessor 22 controls the energization and de-energization of electromagnetic coil 54 via a control circuit 60. Control circuit 60, for example, may include a solid state switching device 62 for controlling the energization of electromagnetic coil 54, such as a field effect transistor (FET), a solid state switching device 64 for controlling the conductive state of solid state switching device 62, such as an NPN bipolar transistor, a capacitor 66, a Zener diode 68, a diode 70, and resistors 72, 74, 76 and 78.

Electromagnetic coil 54 is connected between the vehicle power supply 19 and ground 82, via the drain and source electrodes D and S of FET 62. Diode 70, resistor 72 and capacitor 66 are serially connected in the recited order from the vehicle power supply 19 to ground 82. The collector electrode C of transistor 64 is connected to the junction 84 between resistor 72 and capacitor 66 via resistor 74. The emitter electrode E is connected to ground 82. Zener diode 68 and resistors 76 and 78 are connected in the recited order between an output port 86 of microprocessor 22 and ground 82. The base electrode B of transistor 64 is connected to the junction 88 between resistors 76 and 78, and the gate electrode G of FET 62 is connected to the collector electrode C of transistor 64.

In the operation of circuit 60, when the output port 86 of microprocessor 22 is low, ie., a logic zero, transistor 64 is in a non-conductive state, and the gate electrode G of FET 62 is essentially at the voltage level of the vehicle power supply 19, causing FET 62 to be in a non-conductive state. Thus, contacts 56 will be open. When microprocessor 22 desires to connect vehicle power supply 19 to battery post 44 of ignition switch 14 it drives output port 86 high, ie., to a logic one level, which switches transistor 64 to a conductive state and connects the gate electrode G of FET 62 to ground 82. The essentially zero voltage between the gate and source electrodes G and S switches FET 62 to a conductive state, energizing electromagnetic coil 54 and closing contacts 56. Thus, the vehicle power supply 19 is connected to battery post 44 of ignition switch 14.

A pair 90 of spaced contacts connected to the vehicle power supply 19 and to the battery post 44 may be concealed within a housing (not shown) which contains the components of control 60. A jumper 92 may be connected to contacts 90 by authorized test personnel to prevent engine 12 from being shut down during testing. If the operator of the vehicle should connect a jumper from the vehicle power supply 19 to battery post 44, defeating the purpose of monitoring apparatus 10, monitoring apparatus 10 contains logic for detecting such a by-pass and the unnecessary idling time of engine 10 due to the by-pass is stored for display on display 28, and/or for downloading by authorized service personnel.

Microprocessor 22 receives two additional inputs 94 and 96. Battery post 44 of ignition switch 14 is connected to input 94 via a voltage divider which includes resistors 95 and 97 which are connected between a +12 volt source of potential, such as the vehicle power supply 19, and input 94, with battery post 44 being connected to a junction 99 between resistors 95 and 97. The ignition and accessory posts 46 and 48 are connected to input 96 via diodes 98 and 100, respectively, and a voltage divider which includes resistors 101 and 103. Resistors 101 and 103 are connected between input 96 and ground 82, with the cathode electrodes of diodes 98 and 100 being connected to a junction 105 between resistors 101 and 103.

The values of the resistors in the voltage divider which includes resistors 95 and 97 are selected such that with contacts 56 of master relay 52 open, input 94 to microprocessor 22 will be high, ie., a logic one, when ignition switch 14 is in the off position, and input 94 will be low, ie., a logic zero, when ignition switch 14 has been operated to an on position in which contact arm 50 is in engagement with output post 46 or output post 48. When contacts 56 are closed, input 94 will be high.

The values of the resistors in the voltage divider which includes resistors 101 and 103 are selected such that with contacts 56 open input 96 will be low, regardless of the position of ignition switch 14. When contacts 56 are closed, input 96 to microprocessor 22 will be high.

In the preferred embodiment of the invention illustrated in the Figures, if the ignition switch 14 has switchable element 50 engaged with either the ignition post 46 or the accessory post 48, monitoring apparatus 10 will disconnect the vehicle power supply 80 from battery post 44 in response to the proper conditions. If element 50 is engaging the ignition post 46, engine 12 is assumed to be running, and accessories energizable via ignition switch 14 may be drawing electrical energy. If engine 12 is running, as assumed, then it is desirable to limit unnecessary idling, with its consumption of fuel, engine emissions, and associated engine wear. If the engine is not running, then any connected accessory indicated by block 16 will be a drain on battery 20. If element 50 is engaging the accessory post 48, engine 12 is not running, but it is desirable to limit the time that accessories 18 are draining battery 20. Thus, it makes no difference in the preferred embodiment of the invention which output post of ignition switch 14 is energized, and the output posts 46 and 48 are simply connected by diodes 98 and 100 to a single input port 96. If it is desired to know which output post of ignition switch 14 is energized, then the two output posts 46 may be connected to separate input ports. For example, different shut off times may be used for the two output posts; or, a definite shut off time may be associated with ignition post 46, to limit fuel consumption, emissions and engine wear, while a dynamic shut off time may be used when accessory post 48 is energized, allowing the accessory post 48 to be energized as long as the battery voltage as sensed by input port 42 exceeds a predetermined level, such as 12.4 volts, for example.

FIG. 2 is a detailed flow diagram of a program 102 for directing the operation of microprocessor 22 according to the teachings cf the invention. As will be hereinafter explained in greater detail, monitoring apparatus 10 turns off the electrical input to ignition switch 14 when in either actuated position thereof upon the occurrence of predetermined sensed events. The vehicle operator may regain control by actuating ignition switch 14 to the off position illustrated in FIG. 1 for a short period of time to enable capacitor 66 to discharge, such as least about 5 seconds. for example. Program 102 will be described starting with ignition switch 14 in the off position illustrated in FIG. 1, and thus program 102 will be in a reset or initialized state which returns control to the vehicle operator.

Program 102 is entered at 104 and step 106 checks an "add stop" flag ASF stored at location 108 of RAM 26 to determine if it is set, ie,. at a logic one level. Since the ignition key 44 is off, flag ASF will be at a logic zero level, ie., reset, and step 106 advances to step 110. Step 110 checks input port 96 to determine if it is high. If input port 96 is high it indicates that contacts 56 are closed and ignition switch 14 has been actuated to an engaged position, with element 50 engaging either output post 46 or 48. Since at this point in the description of program 102 ignition switch 14 is in the off position, step 110 will not find input port 96 high and step 110 proceeds to step 112.

Step 112 increments an "engine off" timer 114 in RAM 26. The accumulated engine off time is stored in software timer 114, and the engine off time may be displayed and continuously updated at location 116 of display 28. Step 112 proceeds to step 118 which resets a shutdown timer 120 in RAM 26. Step 120 proceeds to step 122 which opens master relay 52. Therefore, when ignition switch 14 is in the illustrated off position, master relay 52 will be de-energized. Step 122 proceeds to step 124 which checks the logic level of a shut down flag SDF stored at location 126 of RAM 26. At this stage of the description, flag SDF will be reset and step 124 proceeds to step 128.

Step 128 checks input port 94 to determine if the battery post 44 of ignition switch 14 is high. With master relay 52 de-energized and ignition switch 14 off, step 128 will find that input port 94 is high and step 128 advances to step 135. Step 135 checks a flag BPF, to be hereinafter described, to see if it is set. At this stage of program 102 it will not be set and step 135 proceeds to step 136 which clears flag SDF. Step 136 proceeds to step 130. Step 130 is similar to step 124, determining if flag SDF is set. Since flag SDF will not be set at this point of the description, step 130 advances to step 132. Step 132 is similar to step 128, checking the logic level of input port 94. As long as the operator keeps the ignition key 14 in the off position, program 102 will continue to loop through steps 106, 110, 112, 118, 122, 124, 128, 135, 136, 130 and 132, accumulating time on the engine off timer 114 in step 112.

It will now be assumed that the operator has operated ignition switch 14 to an on position. Program 102 will follow the hereinbefore described steps 106, 110, 112, 118, 122 and 124 to step 128, which will now find input 94 low, as with master relay 52 de-energized and ignition switch 14 on, a logic zero is produced for input 94. Step 128 branches to step 130. Step 130 will still find flag SDF in a reset condition, but step 132 will now find input port 94 low, so step 132 advances to step 134 which energizes master relay 52 by providing a logic one output at output port 86. Thus, master relay 52 closes its contacts 56 and vehicle power supply 19 is connected to battery post 44, providing electrical energy to whichever output post, 46 or 48, is engaged by contact arm 50.

On the next running of program 102, step 106 will still find flag ASF reset and advance to step 110. Step 110 will now find the output of ignition switch 14 high, ie., input port 96 will be high, and step 110 branches to step 138 which determines if vehicle 13 is stationary, such as by checking the input from parking brake sensor 36 to determine if the vehicle parking brake is set. It would also be suitable to check a neutral or a park switch on the vehicle transmission in step 138, as the purpose of step 138 is to determine if the vehicle is stationary, or if it is running on the road.

If vehicle 13 is stationary with ignition switch 14 in an actuated position, ie., element 50 is in engagement with one of the output posts 46 or 48, it will be assumed that engine 12 is running and step 138 advances to step 140 which increments an idle timer stored at location 142 of RAM 26. The accumulated idling time of engine 12 may be displayed at location 144 of display 28.

With the circuit arrangement shown in FIG. 1, idle time includes all time that the ignition switch 14 is providing an output voltage at output post 46 or output post 48 and vehicle 13 is stationary. It would also be suitable to insert a step between steps 138 and 140 which determines if engine 12 is actually running, such as by checking the input from the engine oil pressure sensor 34 and/or the input from the engine RPM sensor 32. If this additional step finds that engine 12 is running it would advance to step 140, and if it finds that engine 12 is not running, it would advance to a step similar to step 112, to log engine off time. Step 140, and, if used, a step similar to step 112, would both advance to step 146, which is similar to steps 124 and 130, checking the condition of shutdown flag SDF. Step 146 will find that flag SDF is not set at this stage of the description, and step 146 advances to step 148.

Step 148 increments shutdown timer 120 in RAM 26, and it clears the by-pass flag BPF stored at location 150 of RAM 26. Step 148 proceeds to step 152 to check if the shutdown timer 120 has expired, ie., reached a predetermined time value. The predetermined time value which will enable shutdown of engine 12 is a programmable value, with an exemplary value being 5 minutes. The value chosen should give the vehicle operator ample time to start the engine 12, if engine 12 is just being started, and it should give ample time for an engine which had been running on the road to dissipate excess heat, as well as to cool an exhaust gas driven turbo or supercharger, if used. Five minutes is a good compromise for both purposes, but other shutdown time values may be used. At this point in the description shutdown timer 120 will not have reached the programmed shutdown time value, and step 152 proceeds to step 128. The program will then follow the hereinbefore described steps 135, 136, 130 and 132 back to step 106.

Program 102 will stay in the loop just described, accumulating time on idle timer 140 and engine shutdown timer 120 until the operator starts to move vehicle 13, or step 152 finds that the programmed shutdown time has been reached. It will be assumed that the operator does not move the vehicle, eg., step 138 continues to find that the parking brake sensor 36 indicates that the brake is engaged, or some other sensor, such as a transmission sensor finds that the vehicle is stationary.

When shutdown timer 120 reaches the predetermined shutdown time, step 152 branches to a part of the program which determines if engine 12 is in a condition suitable for shutdown. For example, it would not be desirable to shut engine 12 down if it has not reached a predetermined operating temperature, such as 120° F. (49° C.). Thus, step 152 advances to step 154 which checks the input from engine temperature sensor 30. If engine 12 has not reached the predetermined operating temperature, step 154 proceeds to step 128 and program 102 stays in a loop which includes step 154 until engine 12 is up to the predetermined operating temperature.

Engine temperature may be the only parameter checked before shutting engine 12 down, but in a preferred embodiment of the invention it is desirable to also check the ambient temperature in step 156 and to check the condition of vehicle power supply 19 in step 158. If step 156 finds the ambient temperature is below a predetermined value, such as about 30° F. (−1° C.), then engine 12 should not be shutdown, especially if it is a diesel engine, as it may be difficult to restart. If, or when, step 156 finds the ambient temperature is suitable for shutdown, step 158 makes sure that the condition of vehicle power supply 19 is adequate for restarting engine 12. For example, step 158 may check the battery charging current sensor 38. If the battery charge rate is not below a predetermined value, such as 5 amperes, for example, step 158 would proceed to step 128. Step 158 may additionally check the condition of the alternator or generator by checking the voltage at input port 42. If the voltage at input port 42 is below a predetermined value, such as 12.4 volts, for example, then engine 12 should not be shutdown, and step 158 would proceed to step 128.

When step 152 finds the shutdown time has expired, and the engine temperature, ambient temperature, and vehicle power supply 19 pass the tests of steps 154, 156 and 158, step 160 is entered which sets the shutdown flag SDF at location 126 of RAM 26, it sets the add stop flag ASF at location 108 of RAM 26, and it opens master relay 52 by dropping the level of output port 86 from a logic one to a logic zero level. Step 160 then proceeds to step 128 which will now find that battery post 44 will no longer be high, since master relay 52 was de-energized in step 160 and ignition switch 14 is still on, and step 128 advances to step 130, by-passing steps 135 and 136. Step 130 will now find flag SDF set, and step 130 returns to step 106.

Step 106 will now find the add stop flag ASF set, since it was just set in step 160, and step 106 branches to step 162. Step 162 checks input port 96 to determine if either of the output posts 46 or 48 of ignition switch 14 is providing an output voltage. Since step 160 opened master relay 52, step 162 should not find a logic one at input port 96, and step 162 proceeds to step 164 which increments an engine stop counter 166 at location 166 of RAM 26, with the number of engine stops initiated by monitoring apparatus 10 being displayed at position 168 of display 28. Step 164 proceeds to step 170 which clears or resets the add stop flag ASF.

If step 162 finds a high input at port 96 it indicates that a jumper 92 has been placed across contacts 56 of master relay 52, and step 162, instead of going to step 164 to increment the stop counter 166, branches to step 172 which sets the by-pass flag BPF at location 150 of RAM 26. Step 172 then proceeds to step 170 which clears flag ASF without advancing the engine stop counter, since engine 12 did not stop with the opening of master relay 52 in step 160.

Step 170 proceeds to step 110 which will find input port 96 low, if contacts 56 have not been jumpered, and step 112 starts to accumulate time on engine off timer 114. Step 118 resets the shutdown timer 120, step 122 opens master relay 52, which should already be open, and step 124 will now find flag SDF set, since it was set in step 160. Step 124 then branches to step 174 which increments an "idling time saved" timer at location 176 of RAM 26, which time value may be displayed at location 178 of display 28. The idling time saved timer 176 indicates the time engine 12 is shutdown by monitoring apparatus 10, and thus indicates the total engine idling time which has not taken place, but which would have taken place were it not for monitoring apparatus 10. Step 174 proceeds to step 128 which will find input port 94 low, proceeding to step 130 which will find flag SDF set, with step 130 thus returning to step 106. Program 102 will then loop through steps 106, 110, 112, 118, 122, 124, 174, 128, and 130, accumulating time on engine off timer 114 and time saved timer 176, until the vehicle operator returns and turns the ignition switch 14 to the off position, regaining control of engine 12.

Should step 162 find that input 96 is high, indicating contacts 56 have been jumpered, steps 172 and 170 will proceed to step 110 which will also find input port 96 high, and step 110 thus proceeds through steps 138 and 140 to step 146. Step 146 will find flag SDF set, and step 146 branches to step 180 which increments a by-pass time timer at location 182 of RAM 26, which time may be displayed at location 184 of display 28. Step 180 proceeds to step 128 which will find input port 94 high, proceeding to step 135. Step 135 will find the by-pass flag BPF set, proceeding to step 130 without going through step 136. Thus, step 130 will find flag SDF set and return to step 106. Program 102 will then loop through steps 106, 110, 138, 140, 146, 180, 128, 135, and 130, accumulating time on the idle timer 142 and the by-pass timer 182 until the operator starts to move vehicle 13, or ignition switch 14 is turned off.

If the operator sets vehicle 13 in motion before shutdown timer 120 reaches the shutdown value, step 138 will find that vehicle 13 is not stationary, eg., parking brake sensor 36 indicates the parking brake has been released, or a transmission switch indicates the transmission is not in neutral or park, or a sensor on the vehicle odometer indicates vehicle 13 is moving, and the like, step 138 will branch to step 186. Step 186 increments a road timer at location 188 of RAM 26, which time value may be displayed at location 190 of display 28. Step 186 proceeds to step 192 which resets shutdown timer 120, and step 192 proceeds to step 194 which clears flag SDF. Step 194 proceeds to step 128, and program 102 follows steps 135, 136, 130 and 132 back to step 106. Program 102 will continue to loop through steps 106, 110, 138, 186, 192, 194, 128, 135, 136, 130 and 132, as long as engine 12 is operating on the road, accumulating time on road timer 188.

Program 102 may continuously sum the values of the engine off timer 114, road timer 188 and idle timer 142, which indicates the total time, with this total time value being stored at location 196 of RAM 26, and displayed at location 198 of display 28.

I claim:

1. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, said ignition switch having first and second on positions, fourth means responsive to the second and third means for timing the co-existence of the ignition switch being in either of the first and second on positions and the vehicle being stationary, and fifth means responsive to said fourth means for causing said first means to disconnect the vehicle power supply from the ignition switch after said fourth means reaches a predetermined period of time.

2. The apparatus of claim 1 including timing means responsive to the time the ignition switch is in the on position while the vehicle power supply is disconnected from the ignition switch, to accumulate engine running time saved.

3. The apparatus of claim 2 including display means for displaying the engine running time saved.

4. The apparatus of claim 1 wherein the vehicle power supply includes a battery, and further including battery charging current sensing means, with the fifth means being additionally responsive to said battery charging current sensing means, causing said first means to disconnect the vehicle power supply from the ignition switch only when the predetermined period of time timed by the fourth means has elapsed and the battery charging current sensing means indicates the battery charging current is less than a predetermined value.

5. The apparatus of claim 1 wherein the vehicle power supply includes a battery, and further including vehicle power supply voltage sensing means, with the fifth means being additionally responsive to said vehicle power supply voltage sensing means, causing said first means to disconnect the vehicle power supply from the ignition switch only when the predetermined period of time timed by the fourth means has elapsed and the vehicle power supply voltage sensing means indicates the power supply voltage exceeds a predetermined value.

6. The apparatus of claim 1 wherein the first means also disconnects the vehicle power supply from the ignition switch in response to the ignition switch being operated to the off position.

7. The apparatus of claim 6 wherein the first means connects the vehicle power supply to the ignition switch in response to the ignition switch being operated from the off to the on position.

8. The apparatus of claim 1 including engine temperature sensor means for detecting the temperature of the vehicle engine, with the fifth means being additionally responsive to said engine temperature means, causing said first means to disconnect the vehicle power supply from the ignition switch only when the predetermined period of time timed by the fourth means has elapsed and the engine temperature means indicates the temperature of the engine exceeds a predetermined value.

9. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, fifth means responsive to said fourth means for causing said first means to disconnect the vehicle power supply from the ignition switch after said fourth means reaches a predetermined period of time, and counting means for counting the number of times the fifth means causes the vehicle power supply to be disconnected from the ignition switch.

10. The apparatus of claim 9 including display means for displaying the number of times the fifth means causes the vehicle power supply to be disconnected from the ignition switch.

11. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, fifth means responsive to said fourth means for causing said first means to disconnect the vehicle power supply from the ignition switch after said fourth means reaches a predetermined period of time, means for detecting when the vehicle power supply is directly connected to the ignition switch via jumper means which by-passes the first means, and timing means for timing the existence of the by-pass during the time the fifth means has caused the first means to disconnect the vehicle power supply from the ignition switch, to accumulate unnecessary engine running time.

12. The apparatus of claim 11 including display means for displaying the unnecessary engine running time.

13. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, fifth means responsive to said fourth means for causing said first means to disconnect the vehicle power supply from the ignition switch after said fourth means reaches a predetermined period of time, and timing means responsive to the time the ignition switch is in the off position, to accumulate total engine off time.

14. The apparatus of claim 13 including display means for displaying total engine off time.

15. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, fifth means responsive to said fourth means for causing said first means to disconnect the vehicle power supply from the ignition switch after said fourth means reaches a predetermined period of time, and timing means responsive to the time the vehicle power supply is connected to the ignition switch, the ignition key is in the on position, and the vehicle is stationary, to accumulate engine idle time.

16. The apparatus of claim 15 including display means for displaying total engine idle time.

17. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, fifth means responsive to said fourth means for causing said first means to disconnect the vehicle power supply from the ignition switch after said fourth means reaches a predetermined period of time, and timing means responsive to the time the vehicle power supply is connected to the ignition switch, the ignition key is in the on position, and the vehicle is stationary, to accumulate engine road time.

18. The apparatus of claim 17 including display means for displaying total engine road time.

19. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, fifth means responsive to said fourth means for causing said first means to disconnect the vehicle power supply from the ignition switch after said fourth means reaches a predetermined period of time, first timing means responsive to the time the ignition switch is in the off position, to accumulate engine off time, second timing means responsive to the time the vehicle power supply is connected to the ignition switch, the ignition key is in the on position, and the vehicle is stationary, to accumulate engine idle time, third timing means responsive to the time the vehicle power supply is connected to the ignition switch, the ignition switch is on, and the vehicle is not stationary, to accumulate total engine road time, and means for storing the sum of the accumulated engine off time, total engine idle time, and total engine road time, to indicate total time.

20. The apparatus of claim 19 including display means for displaying total time.

21. Apparatus for monitoring an engine of a vehicle having an ignition switch operable between on and off positions, a vehicle power supply, and an electrical load selectively connectable to the vehicle power supply via the ignition switch, comprising:

first means for controllably connecting and disconnecting the vehicle power supply to the ignition switch, second means for detecting when the ignition switch is in the on position, third means for detecting when the vehicle is stationary, fourth means responsive to the second and third means for timing the co-existence of the ignition switch being in the on position and the vehicle being stationary, and ambient temperature sensor means, and fifth means responsive to said fourth means and to said ambient temperature means, causing said first means to disconnect the vehicle power supply from the ignition switch when the predetermined period of time timed by the fourth means has elapsed and the ambient temperature means indicates the ambient temperature exceeds a predetermined value.

* * * * *